US011937766B2

(12) United States Patent
Woodrow et al.

(10) Patent No.: US 11,937,766 B2
(45) Date of Patent: Mar. 26, 2024

(54) ROBOTIC CLEANER HAVING ACOUSTIC SURFACE TYPE SENSOR

(71) Applicant: SHARKNINJA OPERATING LLC, Needham, MA (US)

(72) Inventors: Chad Woodrow, Needham, MA (US); David Harting, Mansfield, MA (US); Scott A. Rhodes, North Andover, MA (US); Sienna Ramos, Cambridge, MA (US); Brandon A. Vasquez, Somerville, MA (US); Paul D. Butler, Methuen, MA (US)

(73) Assignee: SharkNinja Operating LLC, Needham, MA (US)

( * ) Notice: Subject to any disclaimer, the term of this patent is extended or adjusted under 35 U.S.C. 154(b) by 202 days.

(21) Appl. No.: 17/024,781

(22) Filed: Sep. 18, 2020

(65) Prior Publication Data

US 2021/0085144 A1 Mar. 25, 2021

Related U.S. Application Data

(60) Provisional application No. 62/985,099, filed on Mar. 4, 2020, provisional application No. 62/903,319, filed on Sep. 20, 2019.

(51) Int. Cl.

| | |
|---|---|
| ***A47L 9/28*** | (2006.01) |
| ***A47L 9/00*** | (2006.01) |
| ***A47L 9/04*** | (2006.01) |
| ***A47L 11/28*** | (2006.01) |
| ***A47L 11/40*** | (2006.01) |

(52) U.S. Cl.

CPC ..... *A47L 9/2826* (2013.01); *A47L 9/009* (2013.01); *A47L 9/0477* (2013.01); (Continued)

(58) Field of Classification Search

CPC ..... A47L 9/2826; A47L 9/009; A47L 9/0477; A47L 9/2852; A47L 11/28; (Continued)

(56) References Cited

U.S. PATENT DOCUMENTS

| | | | |
|---|---|---|---|
| 5,841,259 | A | 11/1998 | Kim et al. |
| 9,399,284 | B2 | 7/2016 | Kwon et al. |

(Continued)

FOREIGN PATENT DOCUMENTS

| | | |
|---|---|---|
| CN | 106037589 | 10/2016 |
| CN | 109152501 | 1/2019 |

(Continued)

OTHER PUBLICATIONS

PCT Search Report and Written Opinion, dated Nov. 24, 2020 in corresponding PCT Application No. PCT/US2020/51351, 10 pages.

(Continued)

*Primary Examiner* — David Redding

(74) *Attorney, Agent, or Firm* — Grossman Tucker Perreault & Pfleger, PLLC

(57) ABSTRACT

A robotic cleaner may include a main body, one or more drive wheels coupled to the main body, one or more surface type sensors coupled to the main body, the one or more surface type sensors being configured to receive robotic motor sound reflected from a surface to be cleaned, the robotic motor sound being generated by one or more motors of the robotic cleaner, and a controller configured to determine a surface type based, at least in part, on the reflected robotic motor sound.

19 Claims, 12 Drawing Sheets

(52) U.S. Cl.
CPC ..... *A47L 9/2852* (2013.01); *A47L 11/28* (2013.01); *A47L 11/4011* (2013.01); *A47L 11/4061* (2013.01); *A47L 11/4066* (2013.01); *A47L 2201/04* (2013.01); *A47L 2201/06* (2013.01)

(58) Field of Classification Search
CPC ..... A47L 11/4011; A47L 11/4061; A47L 11/4066; A47L 2201/04; A47L 2201/06; A47L 9/2831
See application file for complete search history.

(56) References Cited

U.S. PATENT DOCUMENTS

| | | | |
|---|---|---|---|
| 9,923,389 | B2 | 3/2018 | Kwon et al. |
| 2005/0278888 | A1 | 12/2005 | Reindle et al. |
| 2014/0207282 | A1 | 7/2014 | Angle et al. |
| 2017/0049287 | A1 | 2/2017 | Knutson et al. |
| 2019/0133400 | A1 | 5/2019 | Klintemyr et al. |

FOREIGN PATENT DOCUMENTS

| | | |
|---|---|---|
| CN | 109846425 | 6/2019 |
| CN | 109907703 | 6/2019 |
| DE | 102012110996 | 5/2014 |
| DE | 102018209385 | 12/2019 |
| KR | 101156282 | 6/2012 |

OTHER PUBLICATIONS

Chinese Office Action with machine-generated English translation dated Oct. 25, 2022, received in Chinese Patent Application No. 202080065869.8, 22 pages.
Chinese Office Action with machine-generated English translation dated May 18, 2023, received in Chinese Patent Application No. 202080065869.8 (26 pages).

ROBOTIC CLEANER HAVING ACOUSTIC SURFACE TYPE SENSOR

CROSS-REFERENCE TO RELATED APPLICATIONS

The present application claims the benefit of U.S. Provisional Application Ser. No. 62/903,319 filed on Sep. 20, 2019, entitled Robotic Vacuum Cleaner having Acoustic Surface Type Sensor and U.S. Provisional Application Ser. No. 62/985,099 filed on Mar. 4, 2020, entitled Robotic Vacuum Cleaner having Acoustic Surface Type Sensor, each of which are fully incorporated herein by reference.

TECHNICAL FIELD

The present disclosure is generally directed to surface treatment apparatuses and more specifically to a robotic cleaner.

BACKGROUND INFORMATION

Surface treatment apparatuses can include robotic cleaners. A robotic cleaner is configured to autonomously travel about a surface while collecting debris left on the surface. A robotic cleaner can be configured to travel along a surface according to a random and/or predetermined path. When traveling along a surface according to the random path, the robotic cleaner may adjust its travel path in response to encountering one or more obstacles. When traveling along a surface according to a predetermined path, the robotic cleaner may have, in prior operations, developed a map of the area to be cleaned and travel about the area according to a predetermined path based on the map. Regardless of whether the robotic cleaner is configured to travel according to a random or predetermined path, the robotic cleaner may be configured to travel in predetermined patterns. For example, a robotic cleaner may be positioned in a location of increased debris and be caused to enter a cleaning pattern that causes the robotic cleaner to remain in the location of increased debris for a predetermined time.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a robotic cleaner (e.g., a robotic vacuum cleaner). The robotic cleaner may include a suction motor configured to generate suction at an air inlet, at least one side brush having a side brush motor, the side brush being configured to urge debris on a surface towards the air inlet, a dust cup for collecting debris urged into the air inlet, and a surface type sensor. The robotic cleaner is configured to detect a surface type based, at least in part, on robotic motor sound (e.g., sound generated by one or more motors of the robotic cleaner) reflected from a surface to be cleaned (e.g., a floor) and detected by the surface type sensor. Additionally, or alternatively, the robotic cleaner may be configured to detect a surface type based, at least in part, on an acoustic emission (or sound) reflected from a surface to be cleaned that is generated by an acoustic emitter (e.g., a speaker) and detected by the surface type sensor. The acoustic emitter may be coupled to the robotic cleaner at location such that the emission generated therefrom travels in a direction of the surface to be cleaned.

Figure 1:
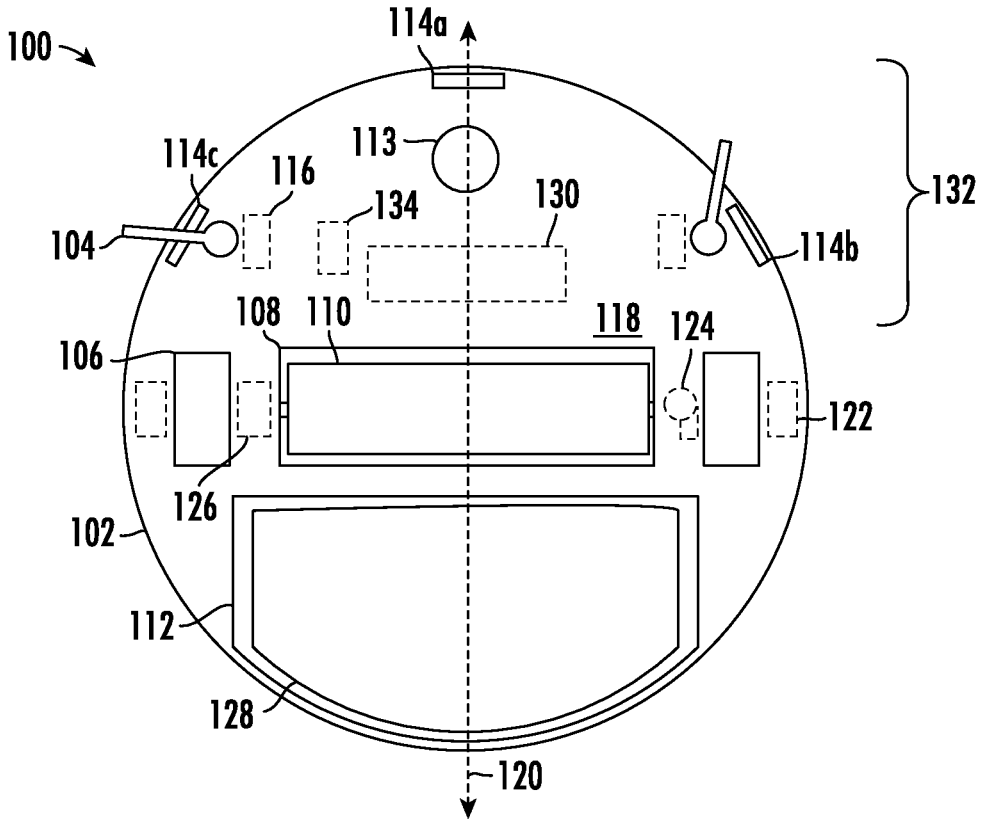
FIG. 1 is a schematic bottom view of an example of a robotic cleaner, consistent with embodiments of the present disclosure.

FIG. 1 shows a schematic bottom view of a robotic cleaner 100. As shown, the robotic cleaner 100 includes a main body 102, one or more side brushes 104 rotatable relative to the main body 102, one or more drive wheels 106 coupled to the main body 102 and configured to urge the robotic cleaner 100 over a surface to be cleaned, an air inlet 108 having a rotatable agitator 110 disposed therein, a dust cup 112, a non-driven supporting wheel 113 (e.g., a caster wheel), and one or more surface type sensors 114 coupled to the main body 102. The one or more surface type sensors 114 may be used to detect a surface type using, for example, robotic motor sound reflected from a surface to be cleaned (e.g., a floor), the robotic motor sound being generated by one or more motors of the robotic cleaner 100.

The one or more side brushes 104 may be driven by a corresponding side brush motor 116 (shown in hidden lines) disposed within the main body 102. Activation of the side brush motor 116 causes a corresponding rotation in a respective side brush 104 about an axis that extends transverse to (e.g., substantially perpendicular to) a bottom surface 118 of the main body 102. Rotation of the one or more side brushes 104 urges debris on a surface to be cleaned (e.g., a floor) towards a central axis 120 of the main body 102, wherein the central axis 120 extends parallel to a direction of forward movement of the robotic cleaner. In other words, rotation of the one or more side brushes 104 urges debris on a surface to be cleaned (e.g., a floor) towards the air inlet 108.

The one or more drive wheels 106 may be driven by a corresponding drive motor 122 (shown in hidden lines). Activation of the drive motor 122 causes a corresponding rotation in a respective drive wheel 106. Differential rotation of a plurality of drive wheels 106 can be used to steer the robotic cleaner 100 over the surface to be cleaned.

The air inlet 108 can be fluidly coupled to a suction motor 124. The suction motor 124 is configured to cause a suction force to be generated at the air inlet 108 such that debris deposited on the surface to be cleaned can be urged into the air inlet 108. The rotatable agitator 110 can be driven by a corresponding agitator motor 126. Rotation of the rotatable agitator 110 may cause at least a portion of the rotatable agitator 110 to engage the surface to be cleaned and dislodge at least a portion of debris deposited thereon. Dislodged debris may then be suctioned into the air inlet 108 as a result of the suction generated by the suction motor 124.

The dust cup 112 is fluidly coupled to the air inlet 108 and the suction motor 124 such that at least a portion of debris suctioned into the air inlet 108 can be deposited within the dust cup 112. The dust cup 112 may also include a pad 128 that is removably coupled thereto. The pad 128 may be configured to receive a liquid such that the robotic cleaner 100 can engage in wet cleaning.

As shown, the robotic cleaner 100 may include a forward surface type sensor 114*a*, a left surface type sensor 114*b*, and a right surface type sensor 114*c*. For example, the left surface type sensor 114*b* and the right surface type sensor 114*c* may be disposed on opposite sides of the central axis 120 of the main body 102 and the forward surface type sensor 114*a* may be positioned such that the central axis 120 extends through the forward surface type sensor 114*a*. However, other configurations are possible. For example, the robotic cleaner 100 may include only the left and right surface type sensors 114*b* and 114*c* arranged on opposite sides of the central axis 120 of the main body 102. By way of further example, the robotic cleaner 100 may include only the forward surface type sensor 114*a* arranged on the central axis 120 such that the central axis 120 extends through the forward surface type sensor 114*a*. The inclusion of the left and right surface type sensors 114*b* and 114*c* allows the robotic cleaner 100 to determine (e.g., using a controller 130) an orientation of the robotic cleaner 100 relative to a transition in surface type (e.g., such that the robotic cleaner 100 can be controlled to follow the transition in surface type).

The surface type sensors 114*a*, 114*b*, and 114*c* can be coupled to and arranged along a periphery of the main body 102 of the robotic cleaner 100. For example, and as shown, the surface type sensors 114*a*, 114*b*, and 114*c* can be arranged about the periphery of a forward portion 132 of the main body 102. The forward portion 132 corresponds to the portion of the main body 102 extending from the one or more drive wheels 106 and in a direction of the one or more side brushes 104.

By arranging the surface type sensors 114*a*, 114*b*, and 114*c* along the periphery of the forward portion 132 of the main body 102, the robotic cleaner 100 may be capable of detecting a transition in surface type before the robotic cleaner 100 traverses the transition in surface type (e.g., before the one or more drive wheels 106 traverse the transition). For example, the robotic cleaner 100 can be configured to avoid traversing the transition in the surface type. As such, one or more of the cleaning implements (e.g., the rotatable agitator 110 or the pad 128) may be prevented from traversing the transition in surface type. This may prevent, for example, a wet pad 128 from contacting a carpeted surface (potentially preventing damage to the carpeted surface). In some instances, the surface type sensor 114 may only be activated when the robotic cleaner 100 is engaging in wet cleaning (e.g., the pad 128 is wet). This may result in reduced power consumption and/or reduce the processing load of the controller 130. In other instances, the surface type sensor 114 may be active in both wet and dry cleaning operations. In these instances, the surface type sensor 114 may also be used to detect an absence of a surface (e.g., the edge of a stair).

The one or more surface type sensors 114 can be acoustic sensors configured to detect robotic motor sound reflected from a surface to be cleaned. Robotic motor sound may include sound generated by one or more motors of the robotic cleaner 100 (e.g., one or more of the side brush motor 116, the drive motor 122, the suction motor 124, and/or the agitator motor 126). The robotic motor sound may be detected by the one or more surface type sensors 114 after being reflected from the surface to be cleaned. Reflected robotic motor sound may have a sufficiently predictable acoustic signature (e.g., amplitude and/or frequency distribution) to allow the robotic cleaner 100 to determine a surface type based, at least in part, on the reflected robotic motor sound. In other words, the surface type can determined using sounds generated naturally (e.g., sound resulting from operation of the robotic cleaner 100 such as robotic motor sound) instead of sounds generated artificially (e.g., sounds generated by an acoustic emitter for the purposes of surface type detection). As such, a surface type can be determined using the surface type sensors 114 without the use of an acoustic emitter (e.g., a speaker). Such a configuration may reduce the overall noise generated by the robotic cleaner 100, the cost of producing the robotic cleaner 100, and/or the size of the robotic cleaner 100.

The one or more surface type sensors 114 may be positioned proximate to one or more of the side brush motor 116, the drive motor 122, the suction motor 124, and/or the agitator motor 126 (e.g., positioned within a distance measuring less than or equal to two times a maximum width, or diameter, of a corresponding motor). By positioning the one or more surface type sensors 114 proximate a corresponding motor, the acoustic signature of the reflected sound may be more readily identified. For example, a magnitude of the reflected signal may be greater at locations proximate to a motor. As shown, the left and right surface type sensors 114*b* and 114*c* may be positioned proximate to corresponding side brush motors 116. Such positioning may minimize an amount of noise (or unwanted acoustic interference) caused by the engagement of the side brush 104 with the surface to be cleaned.

Additionally, or alternatively, the one or more surface type sensors 114 may be configured to detect an emitted sound generated by one or more acoustic emitters (e.g., a speaker) 134 (shown in hidden lines) after being reflected from the surface to be cleaned. The acoustic emitter 134 may be positioned such that the acoustic emitter 134 has an emission axis that extends in a direction of the surface to be cleaned. The emitted sound may be in a range of, for example, 1 hertz (Hz) to 100 kHz. By way of further example, the emitted sound may be in a range of 20 Hz to 20 kHz. By way of still further example, the emitted sound may be in a range of 20 kHz to 100 kHz. In some instances, the surface type sensors 114 may include the acoustic emitter 134. The use of an emission generated by the acoustic emitter 134, after being reflected from the surface to be cleaned, instead of, or in addition to, the robotic motor sound may improve the accuracy of surface type detection.

In some instances, the acoustic emitter 134 may be configured to generate an emission based, at least in part, on the robotic motor sound. For example, the emitted sound may be based, at least in part, on the reflected sound detected by the one or more surface type sensors 114. In some instances, the acoustic emitter 134 may be configured to emit an emitted sound that generally emulates (e.g., approximates) a sound generated by one or more motors of the robotic cleaner 100. In other words, the acoustic emitter 134 may be configured to generate an acoustic emission that emulates the robotic motor sound.

Figure 2:
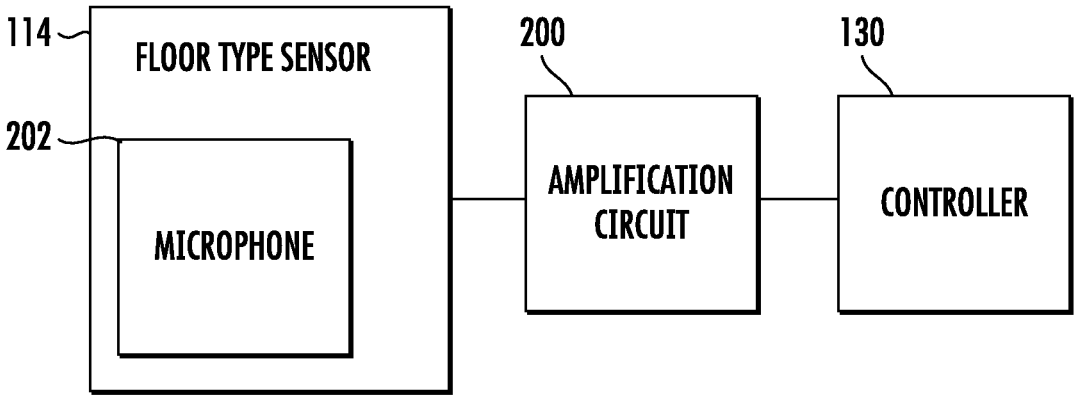
FIG. 2 is a schematic block diagram of a circuit configured to determine a surface type, consistent with embodiments of the present disclosure.

FIG. 2 shows an example of a schematic block circuit diagram in which the surface type sensor 114 is employed to determine a surface type. As shown, the surface type sensor 114 is electrically coupled to an amplification circuit (or amplifier) 200. The amplification circuit 200 is configured to amplify a signal (e.g., a voltage) output by a microphone 202 of the surface type sensor 114. The amplification circuit 200 is electrically coupled to the controller 130 such that the amplified signal output from the amplification circuit 200 can be received by the controller 130. In other words, the controller 130 is electrically coupled to the surface type sensor 114 via the amplification circuit 200. The controller 130 is configured to process the amplified signal such that a surface type may be determined. As such, the controller 130 may generally be described as being configured to determine a surface type based, at least in part, on reflected robotic motor sound. For example, when processing the amplified signal, the controller 130 may use a Fourier transform (e.g., a fast Fourier transform). The controller 130 can also be configured to filter out noise (e.g., unwanted acoustic interference in the detected sound). For example, the controller 130 may be configured to filter out aberrations in the detected sound signal when a respective side brush 104 passes between the surface to be cleaned and a corresponding surface type sensor 114.

The microphone 202 can be configured to detect sound generated by one or more motors of the robotic cleaner 100. For example, the microphone 202 may be configured to detect sound in a frequency range of 1 Hz to 100 kHz. By way of further example, the microphone 202 may be configured to detect sound in a frequency range of 1 Hz to 80 kHz. By way of still further example, the microphone 202 may be configured to detect sound in a frequency range of 20 Hz to 20 kHz.

Figure 3:
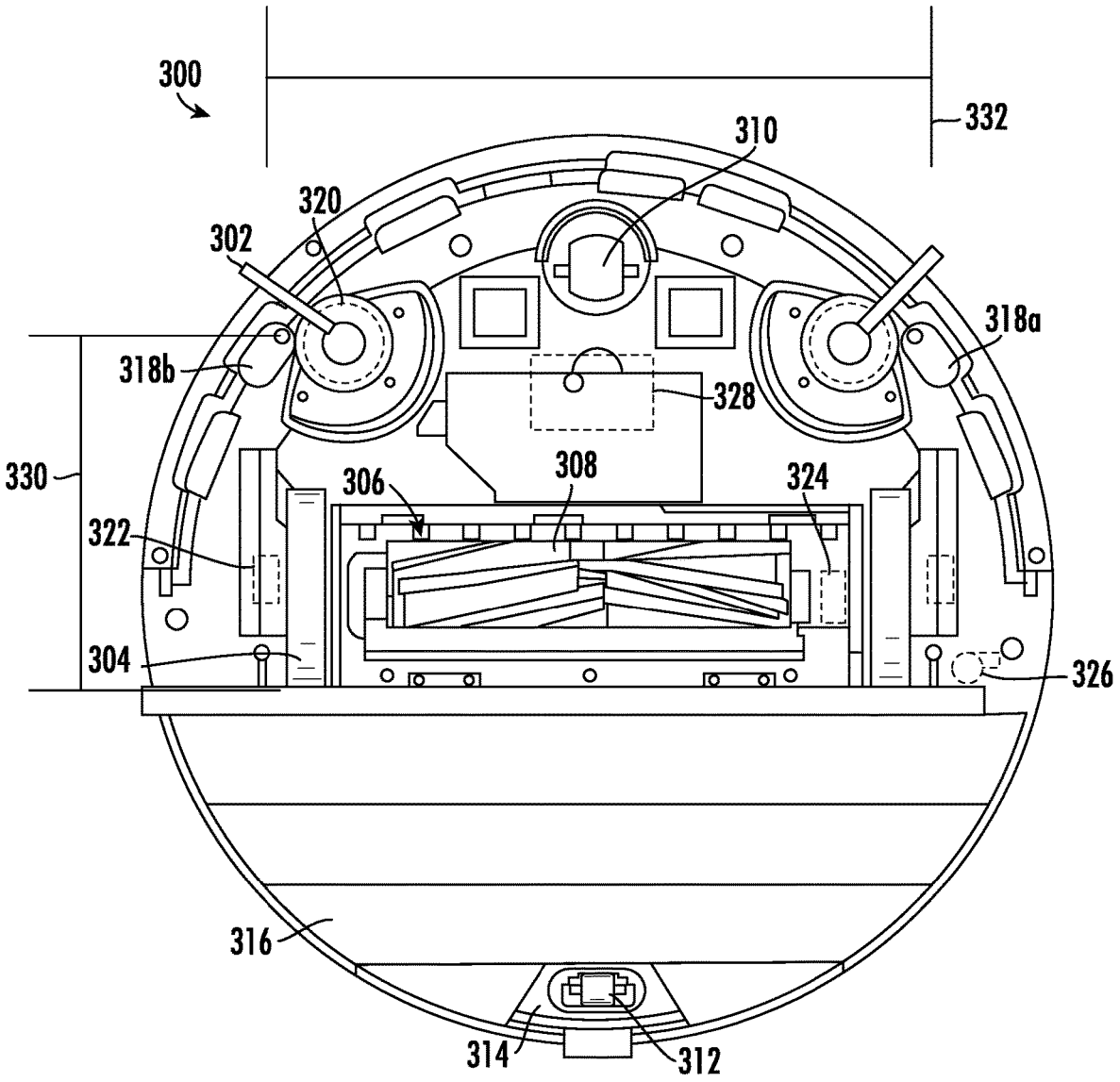
FIG. 3 is a bottom view of an example of a wet/dry robotic cleaner, consistent with embodiments of the present disclosure.

FIG. 3 shows a bottom view of an example of a robotic wet/dry cleaner 300, which may be an example of the robotic cleaner 100 of FIG. 1. As shown, the robotic wet/dry cleaner 300 includes a plurality of side brushes 302, a plurality of drive wheels 304, an air inlet 306 having a rotatable agitator 308 therein, a forward non-driven wheel 310, a rearward non-driven wheel 312, a dust cup 314, a pad 316 removably coupled to the dust cup 314, and a plurality of surface type sensors 318 (e.g., a left surface type sensor 318*a* and a right surface type sensor 318*b*). The plurality of side brushes 302 may be driven by corresponding side brush motors 320 (shown schematically in hidden lines), the plurality of drive wheels 304 may be driven by corresponding drive motors 322 (shown schematically in hidden lines), and the rotatable agitator 308 may be rotated by a corresponding agitator motor 324 (shown schematically in hidden lines). The robotic wet/dry cleaner 300 may further include a suction motor 326 (shown schematically in hidden lines) configured to cause a suction force to be generated at the air inlet 306 such that debris deposited on a surface to be cleaned (e.g., a floor) may be urged therefrom.

The surface type sensors 318 may be spaced apart from the pad 316 by a distance sufficient to permit the robotic wet/dry cleaner 300 to determine (e.g., using a controller 328, shown schematically in hidden lines) a transition in surface type and alter its heading before the pad 316 reaches the transition. Such a configuration may prevent the pad 316 from contacting an adjacent surface type. For example, a sensor-pad separation distance 330 may measure in a range of 100 millimeters (mm) to 150 mm. By way of further example, the sensor-pad separation distance 330 may measure 130 mm. In some instances, a sensor separation distance 332 may be configured to be maximized while still having the sensor-pad separation distance 330 be of a sufficient magnitude to allow the robotic cleaner 300 to change direction and prevent the pad 316 from traversing a detected transition in surface type.

Figure 4:
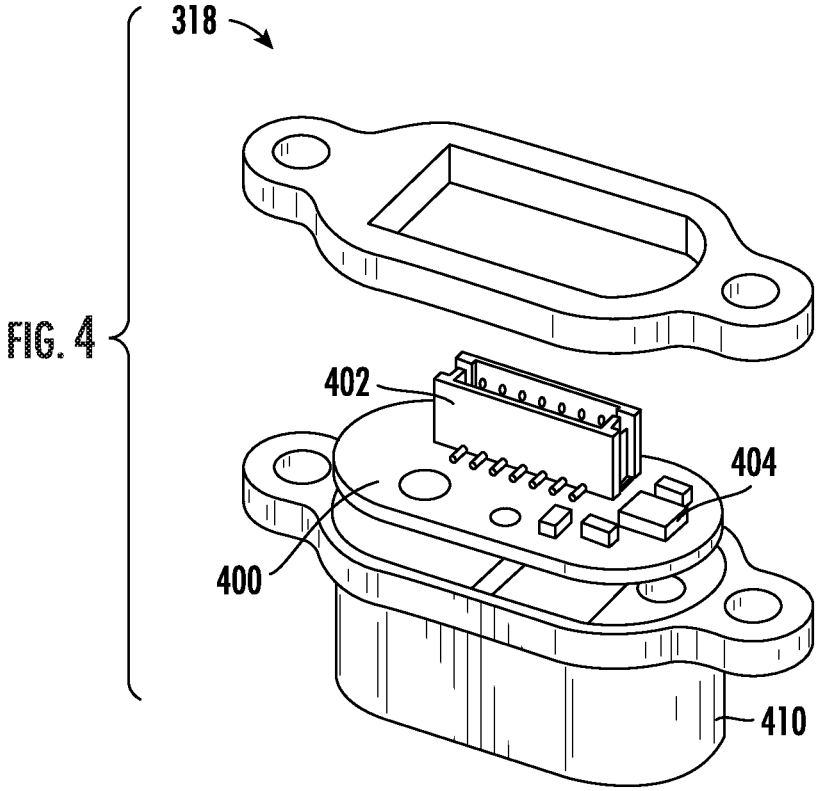
FIG. 4 is an exploded view of an example of a surface type sensor of the wet/dry robotic cleaner of FIG. 3, consistent with embodiments of the present disclosure.
Figure 5:
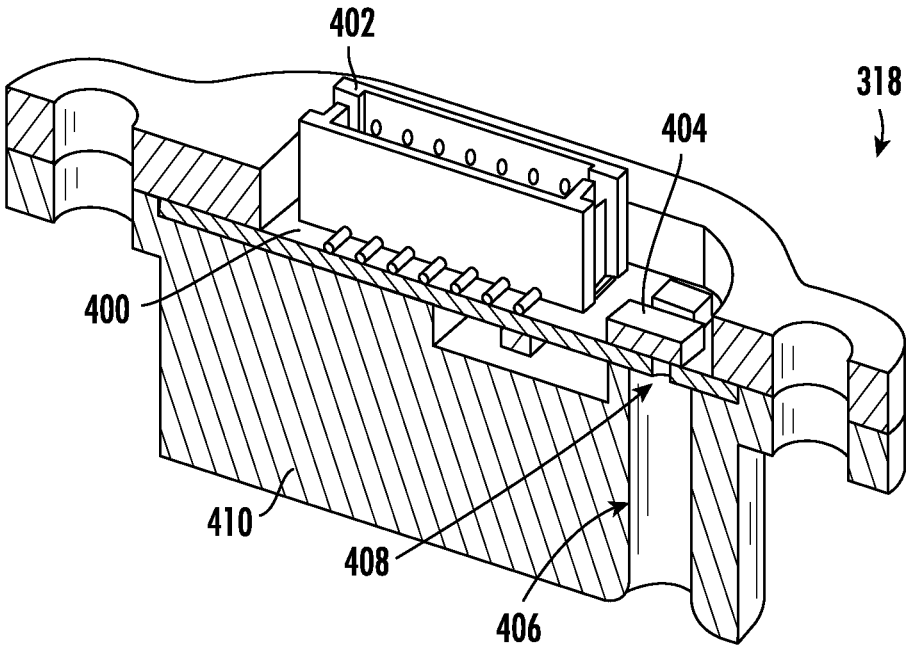
FIG. 5 is a cross-sectional view of the surface type sensor of FIG. 4, consistent with embodiments of the present disclosure.

FIG. 4 shows a perspective exploded view of the surface type sensor 318 and FIG. 5 shows a cross-sectional view of the surface type sensor 318. As shown, the surface type sensor 318 includes a printed circuit board (PCB) 400, a connector 402 electrically coupled to the PCB 400, and a microphone 404 electrically coupled to the PCB 400. As shown, the PCB 400 includes a microphone opening 406 over which at least a portion of the microphone 404 is positioned. The microphone opening 406 is aligned (e.g., centrally aligned) with a collimator 408. The collimator 408 may be a tube extending through a body 410 of the surface type sensor 318 configured to direct acoustic energy (e.g., sound reflected from the surface to be cleaned) into the microphone 404. The microphone 404 may be a ceramic microphone. In some instances, the PCB 400 may include an amplifier circuit configured to amplify the output of the microphone 404.

Figure 6:
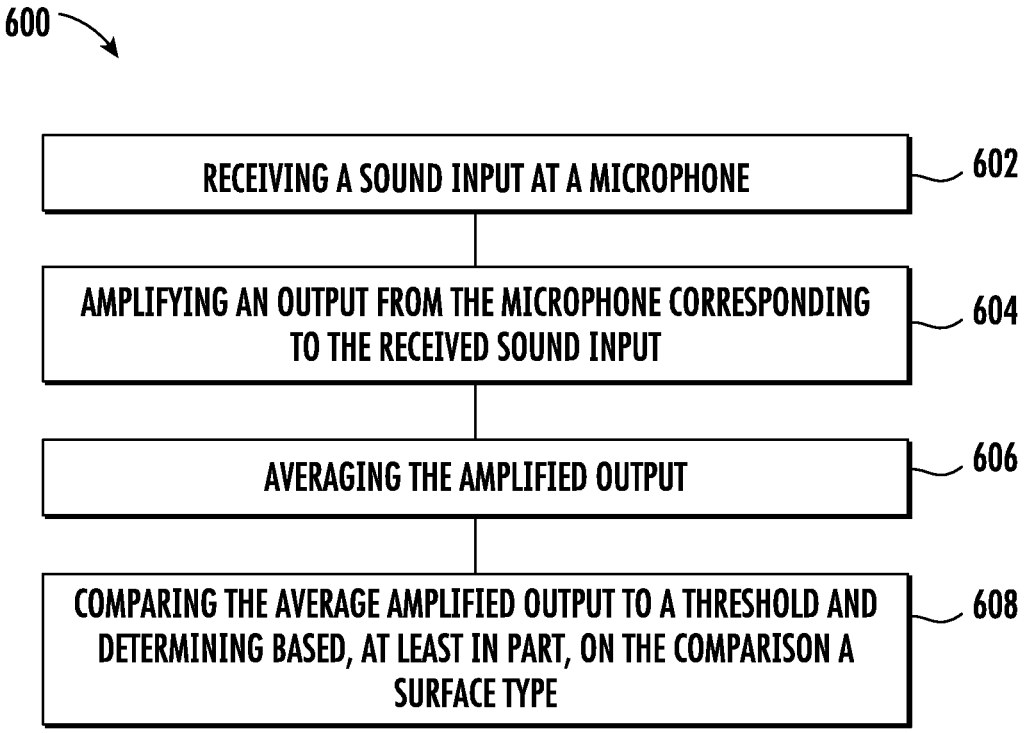
FIG. 6 is a flow chart of an example of a method of surface type detection, consistent with embodiments of the present disclosure.

FIG. 6 shows a flow chart of an example of a method of surface type detection 600 using, for example, the surface type sensor 318. The method of surface type detection 600 may include a step 602. The step 602 may include receiving a sound at the microphone 404 of the surface type sensor 318 and outputting, from the microphone 404, a signal corresponding to the received sound. The received sound includes robotic motor sound generated by one or more of the side brush motors 320, the drive motor 322, the agitator motor 324, and/or the suction motor 326 and reflected from a surface to be cleaned.

Figure 7:
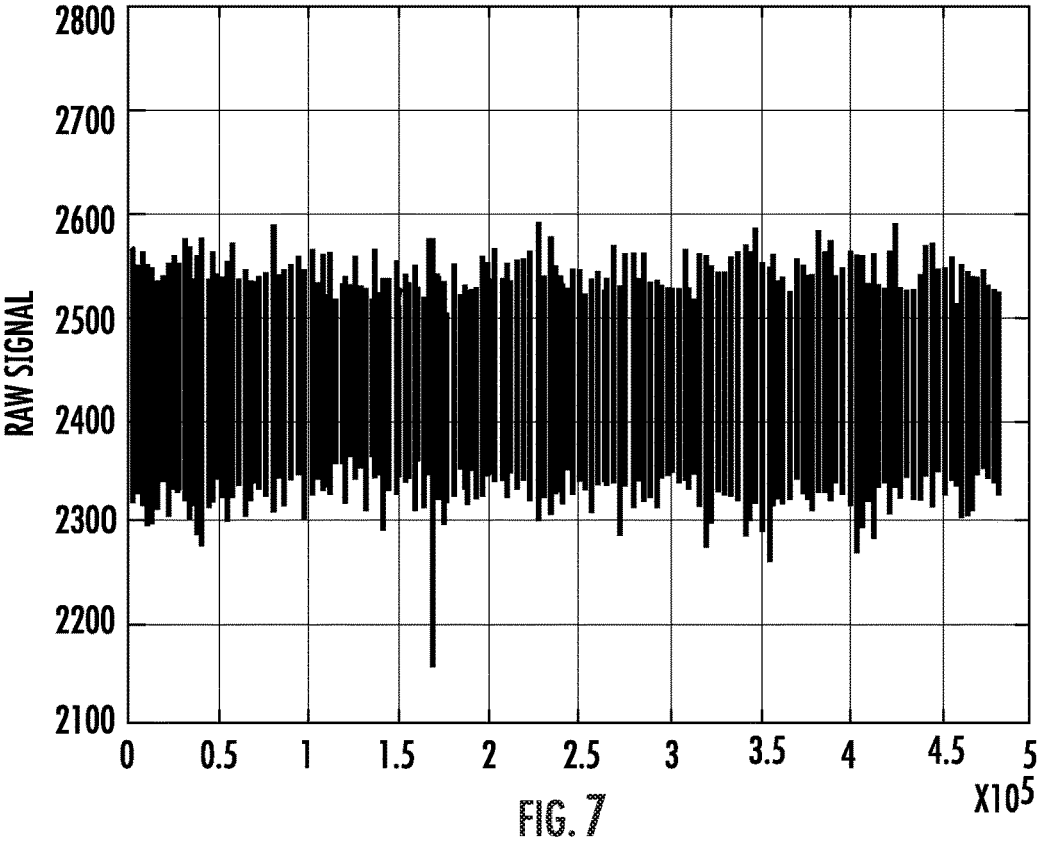
FIG. 7 is an example of an amplified signal received from the surface type sensor of FIG. 4 that corresponds to a soft surface, consistent with embodiments of the present disclosure.
Figure 8:
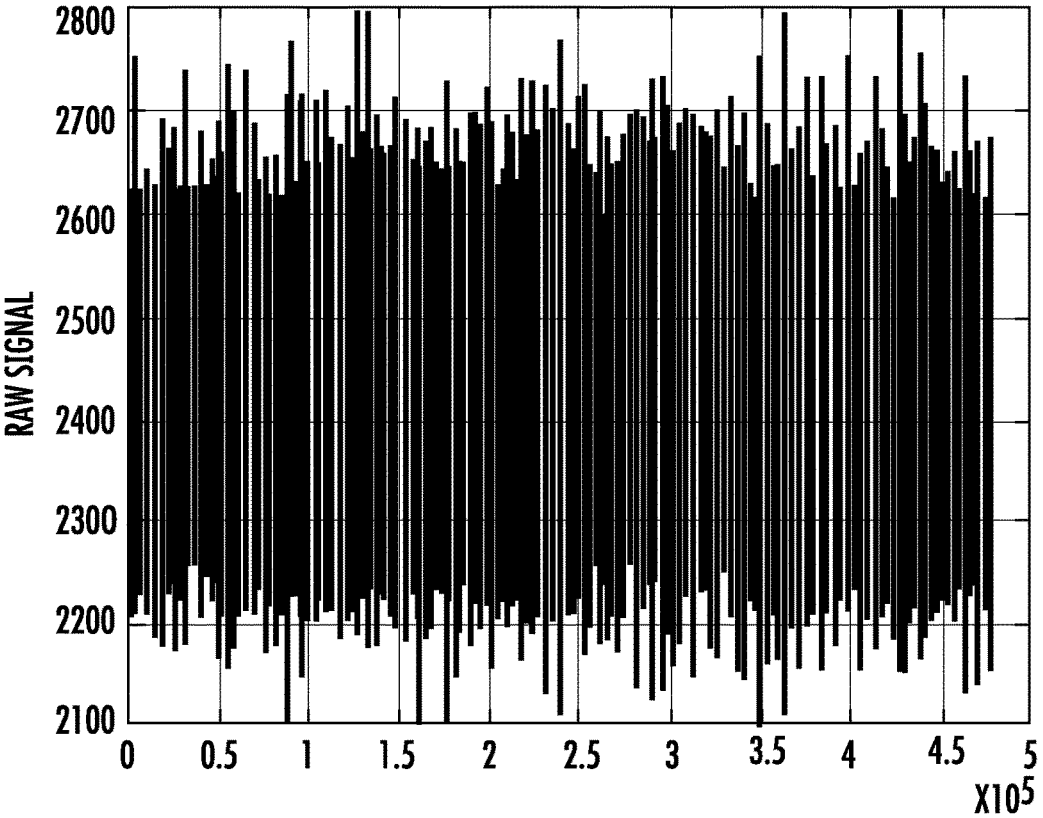
FIG. 8 is an example of an amplified signal received from the surface type sensor of FIG. 4 that corresponds to a hard surface, consistent with embodiments of the present disclosure.

The method of surface type detection 600 may also include a step 604. The step 604 may include amplifying the signal output from the microphone 404. An example of the amplified signal for a soft surface (e.g., a carpet) is generally illustrated in FIG. 7 and an example of the amplified signal for a hard surface (e.g., hardwood) is generally illustrated in FIG. 8.

The method of surface type detection 600 may include a step 606. The step 606 may include averaging the amplified output. As can be seen from FIGS. 7 and 8 an average amplified output corresponding to a soft surface may measure less than an average amplified output corresponding to a hard surface.

The method of surface type detection 600 may include a step 608. The step 608 may include comparing the average amplified output to a threshold and determining a surface type (e.g., a hard floor or a soft floor) based, at least in part, on the comparison to the threshold.

Figure 9:
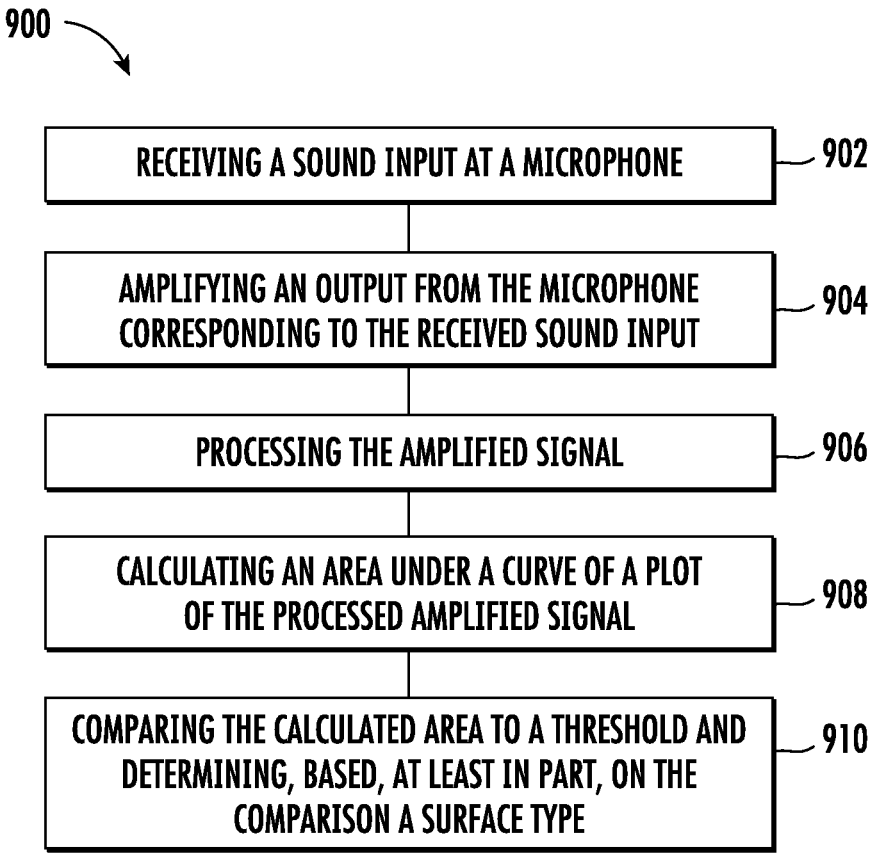
FIG. 9 is a flow chart of an example of a method of surface type detection, consistent with embodiments of the present disclosure.

FIG. 9 shows a flow chart of an example of a method of surface type detection 900 using, for example, the surface type sensor 318. The method of surface type detection 900 may include a step 902. The step 902 may include receiving a sound at the microphone 404 of the surface type sensor 318 and outputting, from the microphone 404, a signal corresponding to the received sound. The received sound includes robotic motor sound generated by one or more of the side brush motors 320, the drive motor 322, the agitator motor 324, and/or the suction motor 326 and reflected from a surface to be cleaned.

The method of surface type detection 900 may also include a step 904. The step 904 may include amplifying the signal output from the microphone 404. An example of the amplified signal for a soft surface (e.g., a carpet) is generally illustrated in FIG. 7 and an example of the amplified signal for a hard surface (e.g., hardwood) is generally illustrated in FIG. 8. In some instances, the signal output from the microphone 404 may not be amplified and may be processed in an unamplified state as discussed in step 906.

Figure 10:
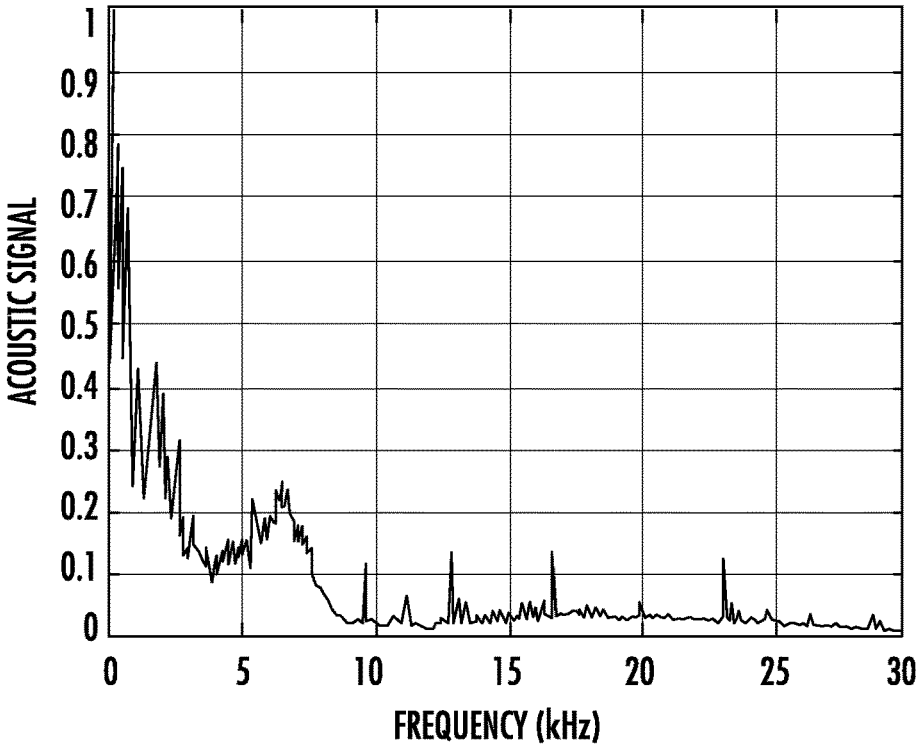
FIG. 10 is a graphical example of a Fourier transform carried out on the amplified signal of FIG. 7, consistent with embodiments of the present disclosure.
Figure 11:
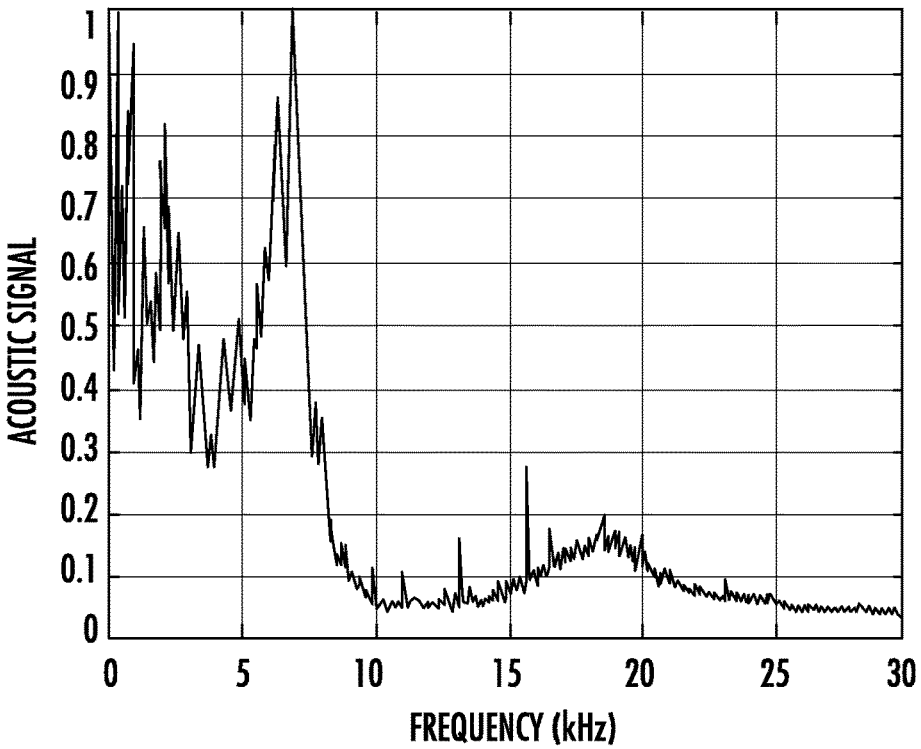
FIG. 11 is a graphical example of a Fourier transform carried out on the amplified signal of FIG. 8, consistent with embodiments of the present disclosure.

The method of surface type detection 900 may include a step 906. The step 906 may include processing the amplified signal. Processing the amplified signal may include converting the amplified signal into a frequency domain (e.g., into values corresponding to acoustic frequencies). For example, the amplified signal may be processed using a Fourier transform to obtain corresponding acoustic frequencies. A graphical example of a Fourier transform carried out on the amplified signal of FIG. 7 is shown in FIG. 10 and a graphical example of a Fourier transform carried out on the amplified signal of FIG. 8 is shown in FIG. 11. The graphical representations of FIGS. 10 and 11 plot frequencies making up a detected sound signal and a relative magnitude corresponding to each detected frequency. For example, and as shown, the graphical representation may plot frequencies on the x-axis and relative magnitude on the y-axis. Processing the amplified signal may also include filtering noise from the amplified signal. Noise may include aberrations generated as a result of, for example, the one or more side brushes 302 passing between the surface to be cleaned and the surface type sensor 318.

In some instances, processing the amplified signal may include using a fast Fourier transform. The signal may be processed using a fast Fourier transform over multiple predetermined time intervals (e.g., a 2 millisecond, a 5 millisecond, a 10 millisecond, a 15 millisecond, and/or any other time interval) and the corresponding outputs of the fast Fourier transforms may be averaged. For example, a fast Fourier transform may be carried out over five predetermined time intervals of five milliseconds and the outputs of the fast Fourier transforms may be averaged. A plot can be generated by averaging the outputs of the fast Fourier transforms.

The method of surface type detection 900 may also include a step 908. The step 908 may include calculating an area between the x-axis and the plotted representation of the Fourier transform (e.g., the area under the curve) for at least one frequency range. In other words, the converted signal may be integrated over at least one frequency range. For example, the frequency range may extend from 0 Hz to 30 kHz. In some instances, the frequency range may generally correspond to a frequency range of the robotic motor sound.

The method of surface type detection 900 may also include a step 910. The step 910 may include comparing the calculated area under a curve to a threshold and based, at least in part, on the comparison determining a surface type (e.g., hard floor or soft floor). In other words, the integrated signal may be compared to a threshold and a surface type may be determined based, at least in part, on the comparison.

Figure 12:
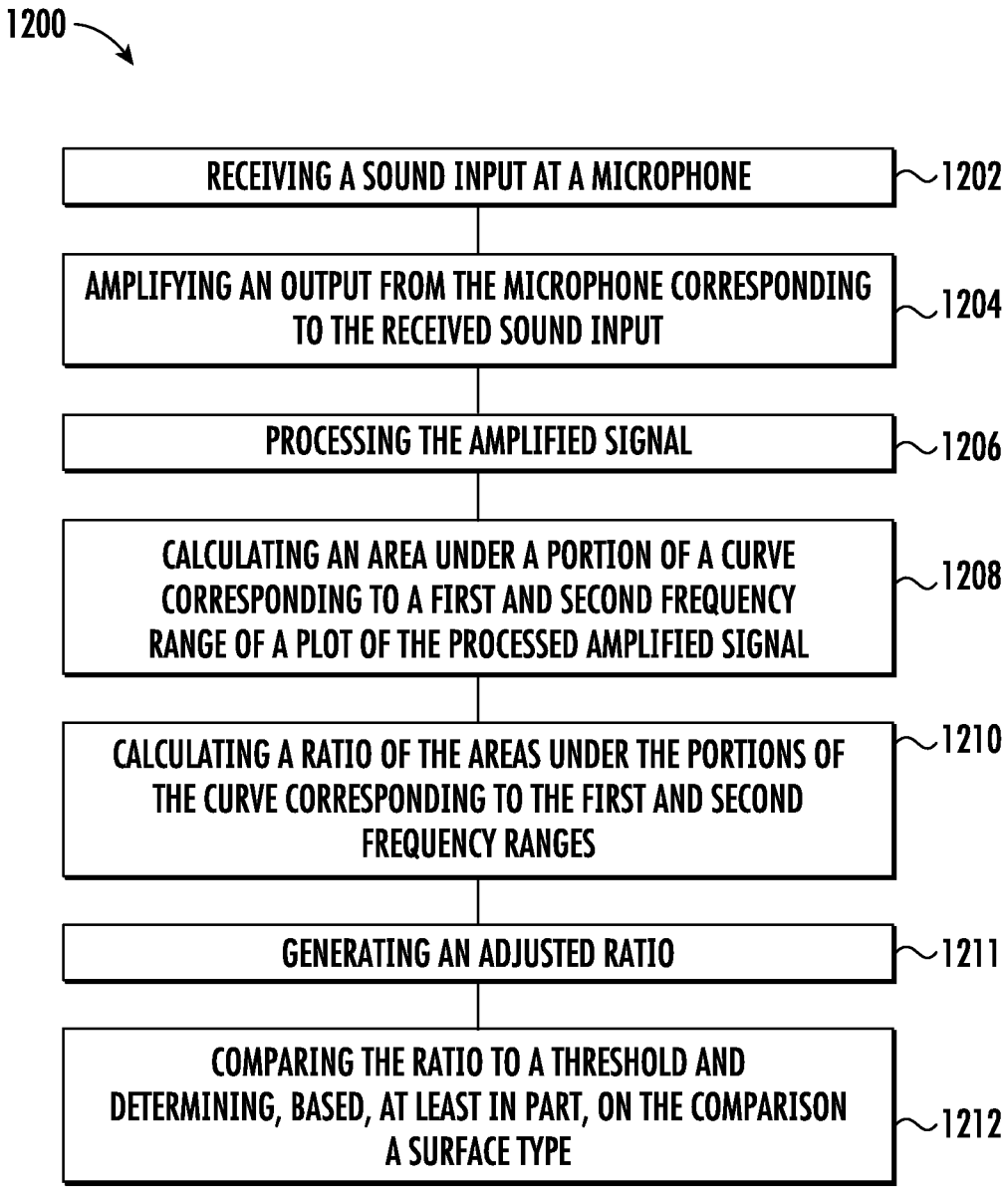
FIG. 12 is a flow chart of an example of a method of surface type detection, consistent with embodiments of the present disclosure.

FIG. 12 shows a flow chart of an example of a method of surface type detection 1200 using, for example, the surface type sensor 318. The method of surface type detection 1200 may include a step 1202. The step 1202 may include receiving a sound at the microphone 404 of the surface type sensor 318 and outputting, from the microphone 404, a signal corresponding to the received sound. The received sound includes robotic motor sound generated by one or more of the side brush motors 320, the drive motor 322, the agitator motor 324, and/or the suction motor 326 and reflected from a surface to be cleaned.

The method of surface type detection 1200 may also include a step 1204. The step 1204 may include amplifying the signal output from the microphone 404. An example of the amplified signal for a soft surface (e.g., a carpet) is generally illustrated in FIG. 7 and an example of the amplified signal for a hard surface (e.g., hardwood) is generally illustrated in FIG. 8. In some instances, the signal output from the microphone 404 may not be amplified and may be processed in an unamplified state as discussed in step 1206.

The method of surface type detection 1200 may include a step 1206. The step 1206 may include processing the amplified signal. Processing the amplified signal may include converting the amplified signal into a frequency domain (e.g., into values corresponding to acoustic frequencies). For example, the amplified signal may be processed using a Fourier transform to obtain corresponding acoustic frequencies. A graphical example of a Fourier transform carried out on the amplified signal of FIG. 7 is shown in FIG. 10 and a graphical example of a Fourier transform carried out on the amplified signal of FIG. 8 is shown in FIG. 11. The graphical representations of FIGS. 10 and 11 plot frequencies making up a detected sound signal and a relative magnitude corresponding to each detected frequency. For example, and as shown, the graphical representation may plot frequencies on the x-axis and relative magnitude on the y-axis. Processing the amplified signal may also include filtering noise from the amplified signal. Noise may include aberrations generated as a result of, for example, the one or more side brushes 302 passing between the surface to be cleaned and the surface type sensor 318.

In some instances, processing the amplified signal may include using a fast Fourier transform. The signal may be processed using a fast Fourier transform over multiple predetermined time intervals (e.g., a 2 millisecond, a 5 millisecond, a 10 millisecond, a 15 millisecond, and/or any other time interval) and the corresponding outputs of the fast Fourier transforms may be averaged. For example, a fast Fourier transform may be carried out over five predetermined time intervals of five milliseconds and the outputs of the fast Fourier transforms may be averaged. A plot can be generated by averaging the outputs of the fast Fourier transforms.

The method of surface type detection 1200 may also include a step 1208. The step 1208 may include calculating an area between the x-axis and the plotted representation of the Fourier transform (e.g., the area under the curve) for a first frequency range and a second frequency range. In other words, the converted signal may be integrated over at least two frequency ranges. The first frequency range may generally correspond to a range of frequencies that are best reflected from a soft surface and the second frequency range may generally correspond to a range of frequencies that are best reflected from a hard surface. For example, the first frequency range may extend from 0 Hz to 10 kHz and the second frequency range may extend from 15 kHz to 20 kHz.

Figure 13:
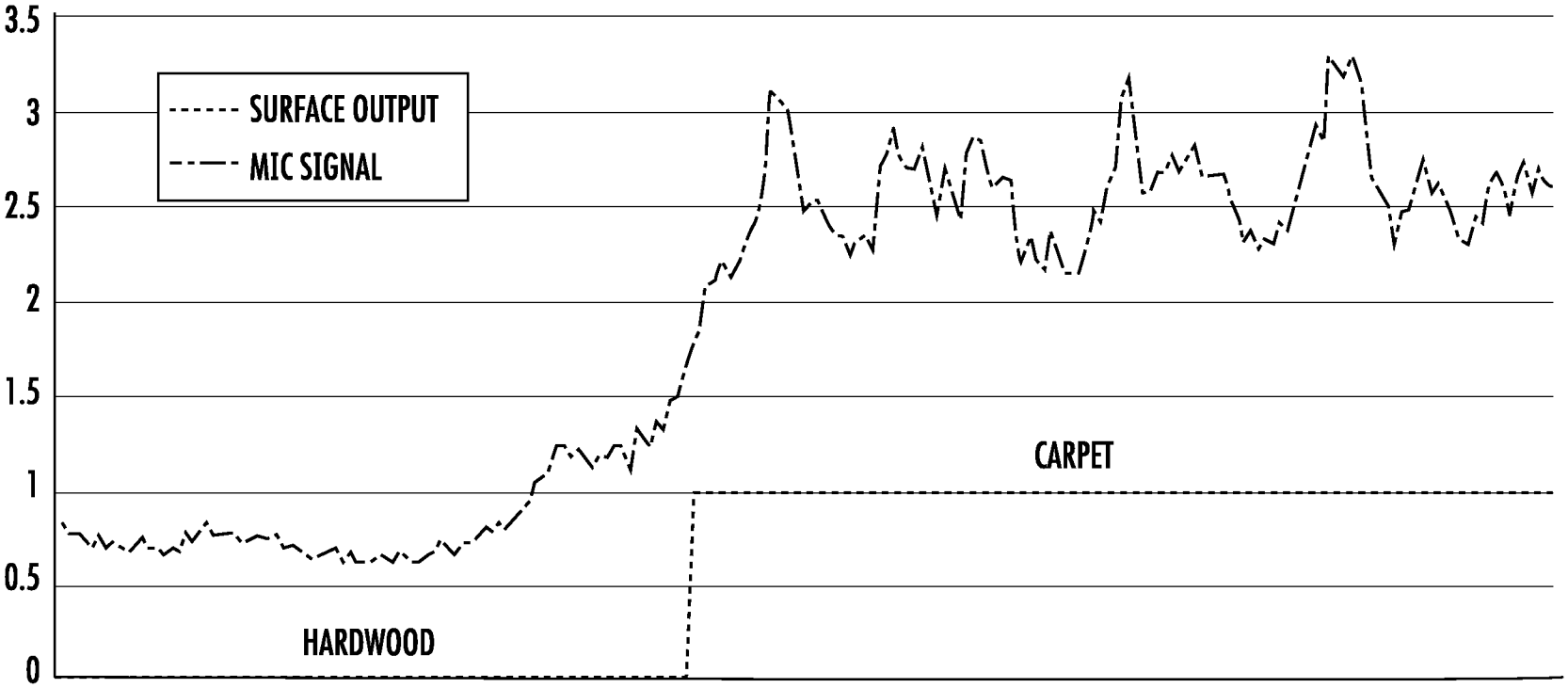
FIG. 13 is a graphical example of a plot of a ratio of a first and a second area under a curve for a signal converted to a frequency domain using a Fourier transform over a predetermined time period, each area corresponding to different frequency ranges and the predetermined time period including a transition between a carpeted floor and hardwood floor, consistent with embodiments of the present disclosure.

The method of surface type detection 1200 may also include a step 1210. The step 1210 may include calculating a ratio for the areas under the curves corresponding to the first and second frequency ranges. In other words, a ratio corresponding to the integrated signal for the first frequency range and the integrated signal for the second frequency range may be calculated. For example, a ratio for the integrated signal at the first and second frequency range may be calculated, wherein the integrated signal for the first frequency range is divided by the integrated signal for the second frequency range. FIG. 13 shows an example of a plot of the ratio calculated over a predetermined time period, wherein a transition between a carpeted and a hardwood floor occurs.

The method of surface type detection 1200 may also include a step 1211. The step 1211 may include generating an adjusted ratio. The adjusted ratio can be based on one or more previously calculated ratios and the currently calculated ratio. For example, the adjusted ratio can be calculated by multiplying the currently calculated ratio by a first coefficient, multiplying one or more the previously calculated ratios by one or more additional coefficients, and summing the results of the multiplication. In some instances, the adjusted ratio can be calculated using an infinite impulse response filter. Equation 1 shows an example of an infinite impulse response (IIR) filter capable of being used to generate the adjusted ratio using the currently calculated ratio, a previously calculated ratio (e.g., the ratio calculated immediately before the currently calculated ratio), and a coefficient (wherein the coefficient measures less than one).

$$IIR_n = (\text{Current Ratio})*(\text{Coefficient}) + (\text{Previous Ratio})*(1-\text{Coefficient}) \quad \text{[Equation 1]}$$

The method of surface type detection 1200 may also include a step 1212. The step 1212 may include comparing the currently calculated ratio (or the adjusted ratio) to a threshold and based, at least in part, on the comparison determining a surface type (e.g., hard floor or soft floor). In some instances, a plurality of ratios can be calculated for different pairs of frequency ranges. Each of these ratios may be compared to a corresponding threshold and based, at least in part, on the comparison a surface type can be determined.

In some instances, a result of the comparison (e.g., exceeding the threshold or falling below the threshold) may be stored and a surface type may be determined after a predetermined number of comparison results have been stored. For example, after a predetermined number of comparison outputs have been stored (e.g., three), a surface type may be determined based, at least in part, on a predetermined number (e.g., two) of the stored comparisons indicating that the threshold was exceeded.

When the adjusted ratio is used, the floor type determination may be more accurate when compared to using the currently calculated ratio alone. For example, the adjusted floor type ratio may deemphasize the effects of noise within the signals used to calculate the ratios, potentially reducing the occurrence of false positives (or false indications of floor type change).

Figure 14:
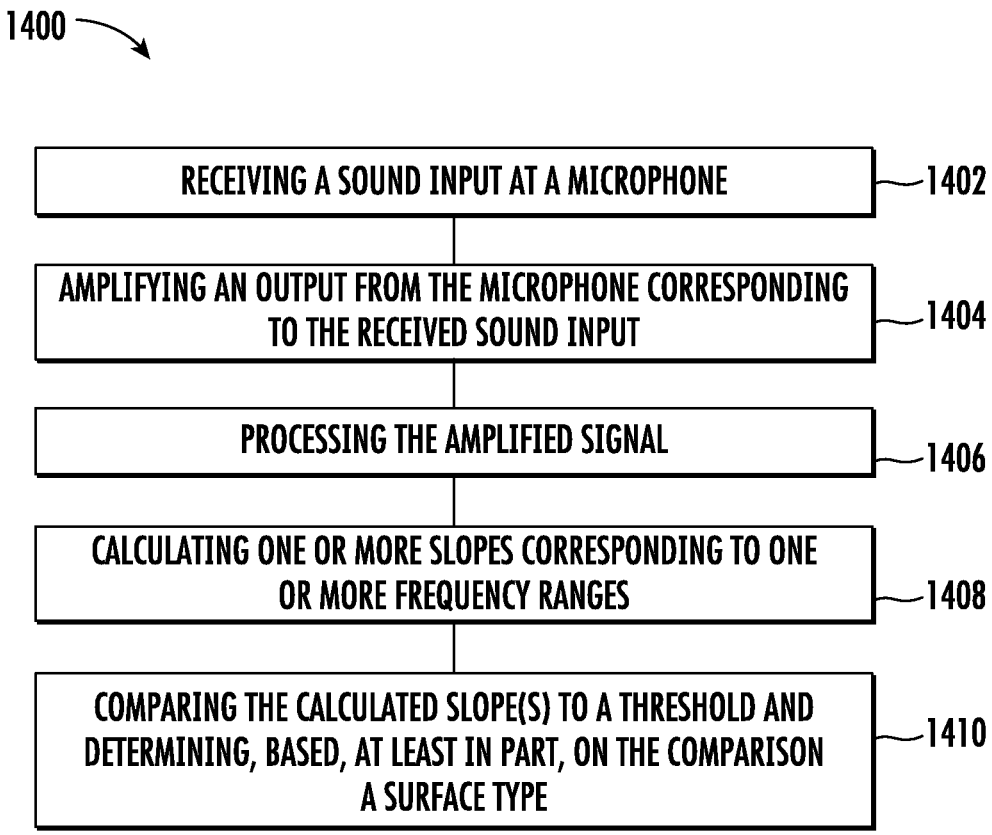
FIG. 14 is a flow chart of an example of a method of surface type detection, consistent with embodiments of the present disclosure.

FIG. 14 shows a flow chart of an example of a method of surface type detection 1400 using, for example, the surface type sensor 318. The method of surface type detection 1400 may include a step 1402. The step 1402 may include receiving a sound at the microphone 404 of the surface type sensor 318 and outputting, from the microphone 404, a signal corresponding to the received sound. The received sound includes robotic motor sound generated by one or more of the side brush motors 320, the drive motor 322, the agitator motor 324, and/or the suction motor 326 and reflected from a surface to be cleaned.

The method of surface type detection 1400 may also include a step 1404. The step 1404 may include amplifying the signal output from the microphone 404. An example of the amplified signal for a soft surface (e.g., a carpet) is generally illustrated in FIG. 7 and an example of the amplified signal for a hard surface (e.g., hardwood) is generally illustrated in FIG. 8. In some instances, the signal output from the microphone 404 may not be amplified and may be processed in an unamplified state as discussed in step 1406.

The method of surface type detection 1400 may include a step 1406. The step 1406 may include processing the amplified signal. Processing the amplified signal may include converting the amplified signal into a frequency domain (e.g., into values corresponding to acoustic frequencies). For example, the amplified signal may be processed using a Fourier transform to obtain corresponding acoustic frequencies. A graphical example of a Fourier transform carried out on the amplified signal of FIG. 7 is shown in FIG. 10 and a graphical example of a Fourier transform carried out on the amplified signal of FIG. 8 is shown in FIG. 11. The graphical representations of FIGS. 10 and 11 plot frequencies making up a detected sound signal and a relative magnitude corresponding to each detected frequency. For example, and as shown, the graphical representation may plot frequencies on the x-axis and relative magnitude on the y-axis. Processing the amplified signal may also include filtering noise from the amplified signal. Noise may include aberrations generated as a result of, for example, the one or more side brushes 302 passing between the surface to be cleaned and the surface type sensor 318.

In some instances, processing the amplified signal may include using a fast Fourier transform. The signal may be processed using a fast Fourier transform over multiple predetermined time intervals (e.g., a 2 millisecond, a 5 millisecond, a 10 millisecond, a 15 millisecond, and/or any other time interval) and the corresponding outputs of the fast Fourier transforms may be averaged. For example, a fast Fourier transform may be carried out over five predetermined time intervals of five milliseconds and the outputs of the fast Fourier transforms may be averaged. A plot can be generated by averaging the outputs of the fast Fourier transforms.

The method of surface type detection 1400 may include a step 1408. The step 1408 may include calculating a slope (or a change in magnitude divided by a change in frequency) of the processed signal over one or more frequency ranges. For example, a first slope corresponding to a first frequency range of the processed signal may be calculated and a second slope corresponding to a second frequency range of the processed signal may be calculated. In some instances, the first frequency range may generally correspond to a range of frequencies that are best reflected from a soft surface and the second frequency range may generally correspond to a range of frequencies that are best reflected from a hard surface. For example, the first frequency range may extend from 0 Hz to 10 kHz and the second frequency range may extend from 15 kHz to 20 kHz.

In some instances, the processed signal may be normalized before a slope over a frequency range is calculated. Normalizing the processed signal may include dividing the processed signal at the one or more frequency ranges by a corresponding direct current (DC) signal at the one or more frequency ranges. Normalization of the processed signal may account for absolute differences in measured sound.

The method of surface type detection 1400 may also include a step 1410. The step 1410 may include comparing the calculated slope to a threshold and based, at least in part, on the comparison determining a surface type (e.g., hard floor or soft floor). In some instances, a plurality of slopes can be calculated, each corresponding to a respective frequency range. Each of these slopes may be compared to a corresponding threshold and based, at least in part, on the comparison a surface type can be determined.

In some instances, a result of the comparison (e.g., exceeding the threshold or falling below the threshold) may be stored and a surface type may be determined after a predetermined number of comparison results have been stored. For example, after a predetermined number of comparison outputs have been stored (e.g., three), a surface type may be determined based, at least in part, on a predetermined number (e.g., two) of the stored comparisons indicating that the threshold was exceeded.

Figure 15:
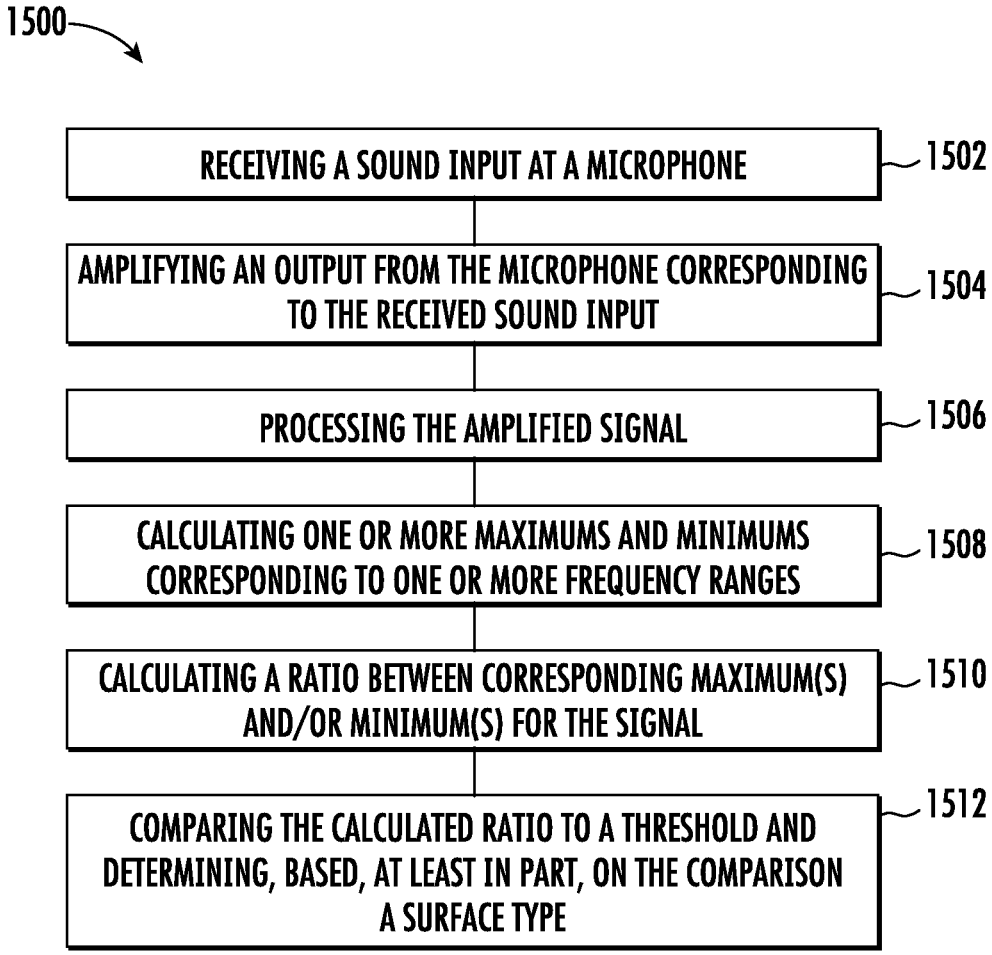
FIG. 15 is a flow chart of an example of a method of surface type detection, consistent with embodiments of the present disclosure.

FIG. 15 shows a flow chart of an example of a method of surface type detection 1500 using, for example, the surface type sensor 318. The method of surface type detection 1500 may include a step 1502. The step 1502 may include receiving a sound at the microphone 404 of the surface type sensor 318 and outputting, from the microphone 404, a signal corresponding to the received sound. The received sound includes robotic motor sound generated by one or more of the side brush motors 320, the drive motor 322, the agitator motor 324, and/or the suction motor 326 and reflected from a surface to be cleaned.

The method of surface type detection 1500 may also include a step 1504. The step 1504 may include amplifying the signal output from the microphone 404. An example of the amplified signal for a soft surface (e.g., a carpet) is generally illustrated in FIG. 7 and an example of the amplified signal for a hard surface (e.g., hardwood) is generally illustrated in FIG. 8. In some instances, the signal output from the microphone 404 may not be amplified and may be processed in an unamplified state as discussed in step 1506.

The method of surface type detection 1500 may include a step 1506. The step 1506 may include processing the amplified signal. Processing the amplified signal may include converting the amplified signal into a frequency domain (e.g., into values corresponding to acoustic frequencies). For example, the amplified signal may be processed using a Fourier transform to obtain corresponding acoustic frequencies. A graphical example of a Fourier transform carried out on the amplified signal of FIG. 7 is shown in FIG. 10 and a graphical example of a Fourier transform carried out on the amplified signal of FIG. 8 is shown in FIG. 11. The graphical representations of FIGS. 10 and 11 plot frequencies making up a detected sound signal and a relative magnitude corresponding to each detected frequency. For example, and as shown, the graphical representation may plot frequencies on the x-axis and relative magnitude on the y-axis. Processing the amplified signal may also include filtering noise from the amplified signal. Noise may include aberrations generated as a result of, for example, the one or more side brushes 302 passing between the surface to be cleaned and the surface type sensor 318.

In some instances, processing the amplified signal may include using a fast Fourier transform. The signal may be processed using a fast Fourier transform over multiple predetermined time intervals (e.g., a 2 millisecond, a 5 millisecond, a 10 millisecond, a 15 millisecond, and/or any other time interval) and the corresponding outputs of the fast Fourier transforms may be averaged. For example, a fast Fourier transform may be carried out over five predetermined time intervals of five milliseconds and the outputs of the fast Fourier transforms may be averaged. A plot can be generated by averaging the outputs of the fast Fourier transforms.

The method of surface type detection 1500 may include a step 1508. The step 1508 may include calculating a maximum and/or a minimum magnitude of the signal within one or more frequency ranges. In some instances, a maximum and a minimum magnitude is calculated for each frequency range. In some instances, only one of a maximum or a minimum magnitude is calculated for each of a plurality of the frequency ranges.

The method of surface type detection 1500 may include a step 1510. The step 1510 may include calculating a ratio between the calculated minimum and maximum magnitude of the signal within the one or more frequency ranges. In some instances, the ratio may be calculated using a maximum and a minimum magnitude corresponding to different frequency ranges. For example, a ratio may be calculated using a maximum or a minimum of a first frequency range and a maximum or a minimum of a second frequency range (e.g., a ratio between maximums, a ratio between minimums, or a ratio between a maximum and a minimum). In some instances, at least one ratio may be calculated using a maximum and a minimum magnitude corresponding to the same frequency range.

In some instances, a maximum and/or minimum magnitude may be calculated for a first frequency range that generally corresponds to a range of frequencies that are best reflected from a soft surface and a maximum and/or minimum magnitude may be calculated for a second frequency range that generally corresponds to a range of frequencies that are best reflected from a hard surface. For example, the first frequency range may extend from 0 Hz to 10 kHz and the second frequency range may extend from 15 kHz to 20 kHz.

The method of surface type detection 1500 may include a step 1512. The step 1512 may include comparing the calculated one or more ratios to one or more thresholds and determining based, at least in part, on the comparison a floor type. In some instances, a result of the comparison (e.g., exceeding the threshold or falling below the threshold) may be stored and a surface type may be determined after predetermined number of comparison results have been stored. For example, after a predetermined number of comparison outputs have been stored (e.g., three), a surface type may be determined based, at least in part, on a predetermined number (e.g., two) of the stored comparisons indicating that the threshold was exceeded.

Figure 16:
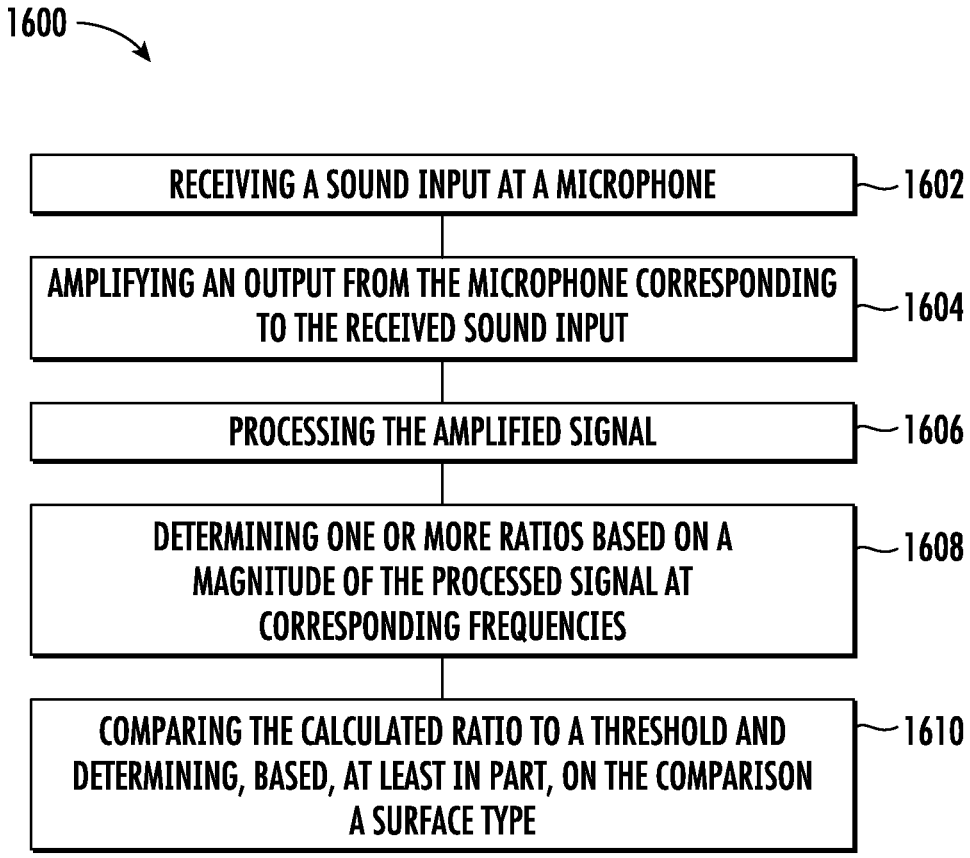
FIG. 16 is a flow chart of an example of a method of surface type detection, consistent with embodiments of the present disclosure.

FIG. 16 shows a flow chart of an example of a method of surface type detection 1600 using, for example, the surface type sensor 318. The method of surface type detection 1600 may include a step 1602. The step 1602 may include receiving a sound at the microphone 404 of the surface type sensor 318 and outputting, from the microphone 404, a signal corresponding to the received sound. The received sound includes robotic motor sound generated by one or more of the side brush motors 320, the drive motor 322, the agitator motor 324, and/or the suction motor 326 and reflected from a surface to be cleaned.

The method of surface type detection 1600 may also include a step 1604. The step 1604 may include amplifying the signal output from the microphone 404. An example of the amplified signal for a soft surface (e.g., a carpet) is generally illustrated in FIG. 7 and an example of the amplified signal for a hard surface (e.g., hardwood) is generally illustrated in FIG. 8. In some instances, the signal output from the microphone 404 may not be amplified and may be processed in an unamplified state as discussed in step 1606.

The method of surface type detection 1600 may also include a step 1606. The step 1606 may include processing the amplified signal. Processing the amplified signal may include using a demodulation calculation (e.g., an I/Q demodulation calculation) to determine a magnitude of the signal at two or more frequencies. For example, the magnitude of the amplified signal may be calculated for a first and a second frequency.

The method of surface type detection 1600 may also include a step 1608. The step 1608 may include determining a ratio between pairs of determined magnitudes. For example, a ratio may be determined between a first determined magnitude and a second determined magnitude.

The method of surface type detection 1600 may also include a step 1610. The step 1610 may include comparing the calculated one or more ratios to one or more thresholds and determining based, at least in part, on the comparison a floor type. In some instances, a result of the comparison (e.g., exceeding the threshold or falling below the threshold) may be stored and a surface type may be determined after a predetermined number of comparison results have been stored. For example, after a predetermined number of comparison outputs have been stored (e.g., three), a surface type may be determined based, at least in part, on a predetermined number (e.g., two) of the stored comparisons indicating that the threshold was exceeded.

Use of a demodulation calculation, instead of a Fourier transform (e.g., a fast Fourier transform) may reduce processing requirements but may reduce an accuracy of the prediction of floor type. Accuracy while using a demodulation calculation may be improved by increasing a number of frequencies at which a magnitude of the signal is calculated. However, increasing the number of frequencies at which a magnitude of the signal is calculated may increase processing requirements.

While the methods of surface type detection 600, 900, 1200, 1400, 1500, and 1600 generally discuss determining surface type based, at least in part, on robotic motor sound, the methods of surface type detection 600, 900, 1200, 1400, 1500, and 1600 may, additionally (or alternatively), use a sound emitted from an acoustic emitter (e.g., the acoustic emitter 134 of FIG. 1) after being reflected from the surface to be cleaned. The emitted sound may be in a range of, for example, 1 Hz to 100 kHz. By way of further example, the emitted sound may be in a range of 20 Hz to 20 kHz. By way of still further example, the emitted sound may be in a range of 20 kHz to 100 kHz.

The methods of surface type detection 600, 900, 1200, 1400, 1500, and 1600 may be embodied in one or more non-transitory computer readable mediums (e.g., of the controller 328) as one or more instructions stored thereon that, when executed by one or more processors (e.g., of the controller 328), cause the corresponding method of surface type detection 600, 900, 1200, 1400, 1500, or 1600 to be carried out. For example, the controller may generally be described as being configured to carry out at least a portion of one or more of the methods of surface type detection 600, 900, 1200, 1400, 1500, and/or 1600. Additionally, or alternatively, the methods of surface type detection 600, 900, 1200, 1400, 1500, and 1600 may be embodied in circuitry (e.g., application specific integrated circuitry, field programmable gate arrays, and/or the like). In some instances, a portion of the surface type detection methods 600, 900, 1200, 1400, 1500, and 1600 may be carried out using circuitry and a portion may be carried out using one or more instructions embodied in one or more non-transitory computer readable mediums.

Further, in some instances, determination of floor type may use one or more machine learning algorithms to improve the accuracy of the determination of floor type. For example, the machine learning algorithm can be configured to identify the frequency ranges most indicative of specific floor types. In some instances, the machine learning algorithm can be configured to assign weights or coefficients that correspond to specific frequency ranges. In some instances, the machine learning algorithm can be configured to generate an algorithm to be used by the robotic cleaner for floor type detection.

An example of a robotic cleaner, consistent with the present disclosure, may include a main body, one or more drive wheels coupled to the main body, one or more surface type sensors coupled to the main body, the one or more surface type sensors being configured to receive robotic motor sound reflected from a surface to be cleaned, the robotic motor sound being generated by one or more motors of the robotic cleaner, and a controller configured to determine a surface type based, at least in part, on the reflected robotic motor sound.

In some instances, the one or more surface type sensors may include a left surface type sensor and a right surface type sensor, the left and right surface type sensors being disposed on opposite sides of a central axis of the main body. In some instances, the left and right surface type sensors may be arranged along a periphery of the main body. In some instances, the robotic motor sound may be generated by one or more of a suction motor, a side brush motor, a drive motor, and/or an agitator motor. In some instances, the robotic cleaner may further include a side brush configured to be driven by a side brush motor, at least one of the one or more surface type sensors may be positioned proximate to the side brush motor. In some instances, the one or more surface type sensors may include a microphone. In some instances, the robotic cleaner may further include an acoustic emitter configured to generate an acoustic emission, the acoustic emission may emulate the robotic motor sound.

Another example of a robotic cleaner, consistent with the present disclosure, may include one or more surface type sensors configured to receive robotic motor sound reflected from a surface to be cleaned, the robotic motor sound being generated by one or more motors of the robotic cleaner and a controller electrically coupled to the one or more surface type sensors and configured to carry out a method of surface type detection. The method of surface type detection may include converting a signal received from the one or more surface type sensors to a frequency domain, integrating the converted signal over at least one frequency range, comparing the integrated signal to a threshold, and based, at least in part, on the comparison determining a surface type.

In some instances, the one or more surface type sensors may include a left surface type sensor and a right surface type sensor, the left and right surface type sensors being disposed on opposite sides of a central axis of a main body of the robotic cleaner. In some instances, the left and right surface type sensors may be arranged along a periphery of the main body. In some instances, the robotic motor sound may be generated by one or more of a suction motor, a side brush motor, a drive motor, and/or an agitator motor. In some instances, a side brush may be configured to be driven by a side brush motor, at least one of the one or more surface type sensors may be positioned proximate to the side brush motor. In some instances, the robotic cleaner may further include an amplifier configured to amplify an output of the one or more surface type sensors. In some instances, the one or more surface type sensors may include a microphone.

Yet another example of a robotic cleaner, consistent with the present disclosure, may include one or more surface type sensors configured to receive robotic motor sound reflected from a surface to be cleaned, the robotic motor sound being generated by one or more motors of the robotic cleaner and a controller electrically coupled to the one or more surface type sensors and configured to carry out a method of surface type detection. The method of surface type detection may include converting a signal received from the one or more surface type sensors to a frequency domain, integrating the converted signal over a first and a second frequency range, calculating a ratio corresponding to the integrated signal for the first frequency range and the integrated signal for the second frequency range, comparing the ratio to a threshold, and based, at least in part, on the comparison determining a surface type.

In some instances, the one or more surface type sensors may include a left surface type sensor and a right surface type sensor, the left and right surface type sensors being disposed on opposite sides of a central axis of a main body of the robotic cleaner. In some instances, the left and right surface type sensors are arranged along a periphery of the main body. In some instances, the robotic motor sound may be generated by one or more of a suction motor, a side brush motor, a drive motor, and/or an agitator motor. In some instances, the robotic cleaner may further include a side brush configured to be driven by a side brush motor, at least one of the one or more surface type sensors may be positioned proximate to the side brush motor. In some instances, the robotic cleaner may further include an amplifier configured to amplify an output of the one or more surface type sensors. In some instances, the one or more surface type sensors may include a microphone.

Yet another example of a robotic cleaner, consistent with the present disclosure, may include an acoustic emitter configured to generate an acoustic emission in a direction of a surface to be cleaned such that the acoustic emission is reflected from the surface to be cleaned, one or more surface type sensors configured to receive the reflected acoustic emission, and a controller electrically coupled to the one or more surface type sensors and configured to carry out a method of surface type detection. The method of surface type detection may include converting a signal received from the one or more surface type sensors to a frequency domain, integrating the converted signal over at least one frequency range, comparing the integrated signal to a threshold, and based, at least in part, on the comparison determining a surface type.

In some instances, the acoustic emission may be configured to emulate robotic motor sound. In some instances, the acoustic emission may be based, at least in part, on robotic motor sound detected by the one or more surface type sensors.

Yet another example of a robotic cleaner, consistent with the present disclosure, may include an acoustic emitter configured to generate an acoustic emission in a direction of a surface to be cleaned such that the acoustic emission is reflected from the surface to be cleaned, one or more surface type sensors configured to receive the reflected acoustic emission, and a controller electrically coupled to the one or more surface type sensors and configured to carry out a method of surface type detection. The method of surface type detection may include converting a signal received from the one or more surface type sensors to a frequency domain, integrating the converted signal over a first and a second frequency range, calculating a ratio corresponding to the integrated signal for the first frequency range and the integrated signal for the second frequency range, comparing the ratio to a threshold, and based, at least in part, on the comparison determining a surface type.

In some instances, the acoustic emission may be configured to emulate robotic motor sound. In some instances, the acoustic emission may be based, at least in part, on robotic motor sound detected by the one or more surface type sensors.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

a main body;

one or more drive wheels coupled to the main body;

a side brush configured to be driven by a side brush motor, the side brush being configured to rotate about an axis that extends transverse to a bottom surface of the main body;

one or more surface type sensors coupled to the main body at a distance from the side brush motor that is less than two times a maximum width of the side brush motor, the one or more surface type sensors being configured to receive robotic motor sound reflected from a surface to be cleaned, the robotic motor sound being generated by one or more motors of the robotic cleaner; and a controller configured to determine a surface type based, at least in part, on the reflected robotic motor sound.

2. The robotic cleaner of claim 1, wherein the one or more surface type sensors include a left surface type sensor and a right surface type sensor, the left and right surface type sensors being disposed on opposite sides of a central axis of the main body.

3. The robotic cleaner of claim 2, wherein the left and right surface type sensors are arranged along a periphery of the main body.

4. The robotic cleaner of claim 1, wherein the robotic motor sound is generated by one or more of a suction motor, the side brush motor, a drive motor, and/or an agitator motor.

5. The robotic cleaner of claim 1 further comprising an acoustic emitter configured to generate an acoustic emission, the acoustic emission emulating the robotic motor sound.

6. A robotic cleaner comprising:

one or more surface type sensors configured to receive robotic motor sound reflected from a surface to be cleaned, the robotic motor sound being generated by one or more motors of the robotic cleaner; and a controller electrically coupled to the one or more surface type sensors and configured to carry out a method of surface type detection comprising:

converting a signal received from the one or more surface type sensors to a frequency domain;

integrating the converted signal over at least one frequency range;

comparing the integrated signal to a threshold; and based, at least in part, on the comparison determining a surface type.

7. The robotic cleaner of claim 6, wherein the one or more surface type sensors include a left surface type sensor and a right surface type sensor, the left and right surface type sensors being disposed on opposite sides of a central axis of a main body of the robotic cleaner.

8. The robotic cleaner of claim 7, wherein the left and right surface type sensors are arranged along a periphery of the main body.

9. The robotic cleaner of claim 6, wherein the robotic motor sound is generated by one or more of a suction motor, a side brush motor, a drive motor, and/or an agitator motor.

10. The robotic cleaner of claim 6 further comprising a side brush configured to be driven by a side brush motor, at least one of the one or more surface type sensors is positioned proximate to the side brush motor.

11. The robotic cleaner of claim 6 further comprising an amplifier configured to amplify an output of the one or more surface type sensors.

12. The robotic cleaner of claim 6, wherein the one or more surface type sensors include a microphone.

13. A robotic cleaner comprising:

one or more surface type sensors configured to receive robotic motor sound reflected from a surface to be cleaned, the robotic motor sound being generated by one or more motors of the robotic cleaner; and a controller electrically coupled to the one or more surface type sensors and configured to carry out a method of surface type detection comprising:

converting a signal received from the one or more surface type sensors to a frequency domain;

integrating the converted signal over a first and a second frequency range;

calculating a ratio corresponding to the integrated signal for the first frequency range and the integrated signal for the second frequency range;

comparing the ratio to a threshold; and based, at least in part, on the comparison determining a surface type.

14. The robotic cleaner of claim 13, wherein the one or more surface type sensors include a left surface type sensor and a right surface type sensor, the left and right surface type sensors being disposed on opposite sides of a central axis of a main body of the robotic cleaner.

15. The robotic cleaner of claim 14, wherein the left and right surface type sensors are arranged along a periphery of the main body.

16. The robotic cleaner of claim 13, wherein the robotic motor sound is generated by one or more of a suction motor, a side brush motor, a drive motor, and/or an agitator motor.

17. The robotic cleaner of claim 13 further comprising a side brush configured to be driven by a side brush motor, at least one of the one or more surface type sensors is positioned proximate to the side brush motor.

18. The robotic cleaner of claim 13 further comprising an amplifier configured to amplify an output of the one or more surface type sensors.

19. The robotic cleaner of claim 13, wherein the one or more surface type sensors include a microphone.

* * * * *